United States Patent [19]

Claypool et al.

[11] Patent Number: 4,904,850

[45] Date of Patent: Feb. 27, 1990

[54] LAMINAR ELECTRICAL HEATERS

[75] Inventors: James L. Claypool, Los Altos Hills; Thomas A. Kridl, Los Altos; Lee M. Middleman, Portola Valley, all of Calif.

[73] Assignee: Raychem Corporation, Menlo Park, Calif.

[21] Appl. No.: 325,079

[22] Filed: Mar. 17, 1989

[51] Int. Cl.[4] ..... H05B 3/10

[52] U.S. Cl. ..... 219/548; 219/528; 219/553; 338/22 SD

[58] Field of Search ..... 338/293, 271, 332, 333, 338/236, 309, 327, 328, 22 SD; 219/548, 553

[56] References Cited

U.S. PATENT DOCUMENTS 4,426,633 1/1984 Taylor ..... 338/25

4,635,026 1/1987 Takeuchi ..... 338/22 SD 4,689,475 8/1987 Matthiesen ..... 219/553

4,706,060 11/1987 May ..... 338/271

4,719,335 1/1988 Batliwalla et al. ..... 219/528

4,783,587 11/1988 Ishii et al. ..... 219/548

*Primary Examiner*—B. A. Reynolds

*Assistant Examiner*—M. M. Lateef

*Attorney, Agent, or Firm*—Timothy H. P. Richardson; Marguerite E. Gerstner; Herbert G. Burkard

[57] ABSTRACT

An electrical heater which has a conductive polymer resistive element and two laminar electrodes. The electrodes are shaped and positioned such that there is a continuous margin around the periphery of the resistive element on at least one surface. The margin is particularly useful in reducing arcing which may occur between the electrodes.

17 Claims, 2 Drawing Sheets

LAMINAR ELECTRICAL HEATERS

This application is a continuation of application Ser. No. 130,264, filed Dec. 8, 1987, now abandoned.

BACKGROUND OF THE INVENTION

1. Field of the Invention

This invention relates to the use of conductive polymers in heaters.

2. Introduction to the Invention

Conductive polymers are well-known for use in electrical devices such as circuit protection devices and heating elements. Such elements, and compositions and processes useful for making such elements, are described in U.S. Pat. Nos. 3,179,544, 3,399,451, 3,793,716, 3,858,144, 3,861,029, 3,914,363, 4,017,715, 4,085,286, 4,095,044, 4,135,587, 4,177,376, 4,177,446, 4,223,209, 4,237,441, 4,272,471 4,304,987, 4,314,230, 4,315,237, 4,318,220, 4,317,027, 4,318,220, 4,327,351, 4,330,703, 4,388,607, 4,421,582, 4,517,449, 4,532,164, 4,543,474, 4,548,662, 4,654,511, 4,689,475, and 4,700,054 and in copending commonly assigned U.S. application Ser. Nos. 141,989, 784,288 (now U.S. Pat. No. 4,743,321), 938,659, 053,610 (now U.S. Pat. No. 4,777,351), and 119,618. The disclosure of each of these patents and pending applications is incorporated herein by reference.

Laminar heating elements are particularly useful for distributing heat uniformly over wide areas either by direct physical and thermal contact or through radiant heating. Devices comprising such heaters are described in U.S. Pat. Nos. 4,426,633, and 4,689,475, and in copending commonly assigned U.S. Application Ser. Nos. 818,844, 818,845, 818,846, 913,290, 75,929, and 89,093. The disclosure of each of these patents and pending applications is incorporated herein by reference.

SUMMARY OF THE INVENTION

In testing sheet heaters of the kind discussed above, we have discovered that even when the heaters are apparently fully insulated, it is sometimes possible for moisture (or other electrolyte) to gather in voids inadvertently formed between the insulation and the conductive polymer around the periphery of the conductive polymer heating element, and thus to permit arcing between the electrodes, and consequential damage to the heater. We have discovered that the danger of such arcing can be substantially reduced by ensuring that at least one of the electrodes is set back from the periphery of the resistive element, e.g. by trimming back one or both of the electrodes, in the regions where the presence of voids is a possibility, preferably around the whole periphery of the heating element, so as substantially to increase the distance over which an arc between the electrodes must be struck and maintained. An equivalent result can be obtained by securing an insulating element to the resistive element around the periphery thereof in such a way as to eliminate all possibility of a void between the insulating and resistive elements.

In one aspect, the invention provides (1) a laminar resistive element which is composed of a conductive polymer and which has a first face and an opposite second face;

(2) a first laminar electrode which is secured to the first face of the resistive element; and (3) a second laminar electrode which is secured to the second face of the resistive element;

the first and second electrodes being connectable to a power supply, whereby current can be passed through the resistive element; and the first and second electrodes being so shaped and positioned that there is a continuous marginal portion around the whole of the periphery of the resistive element in which at most one of the first and second electrodes is present.

BRIEF DESCRIPTION OF THE DRAWINGS

The invention is illustrated in the accompanying drawing in which.

DETAILED DESCRIPTION OF THE INVENTION

Figure 1:
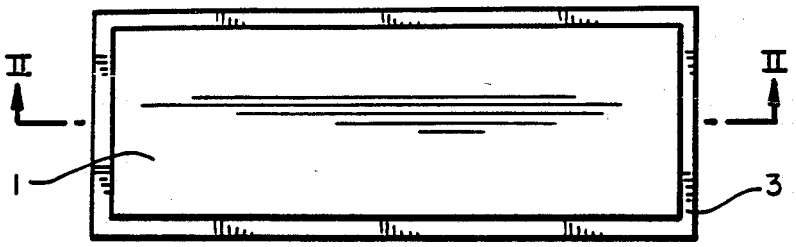
FIGS. 1, 3 and 5 are plan views of a first, second and third heaters of the invention.
Figure 2:
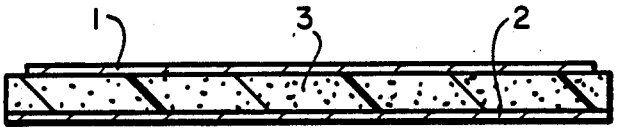
FIGS. 2, 4 and 6 are cross-section on lines II—II, IV—IV and VI—VI of FIGS. 1, 3 and 5, respectively.
Figure 3:
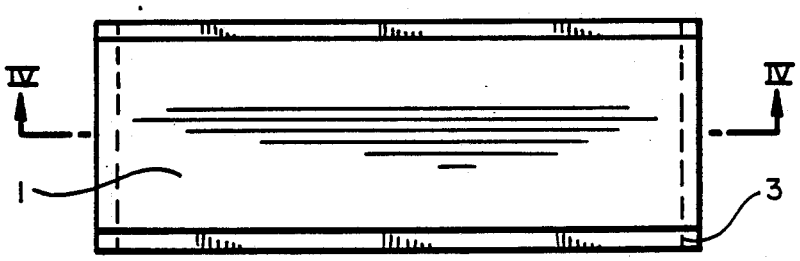
Figure 4:
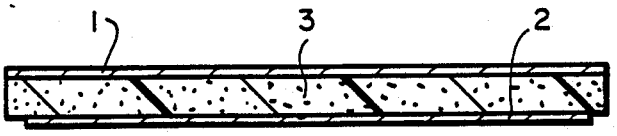
Figure 5:
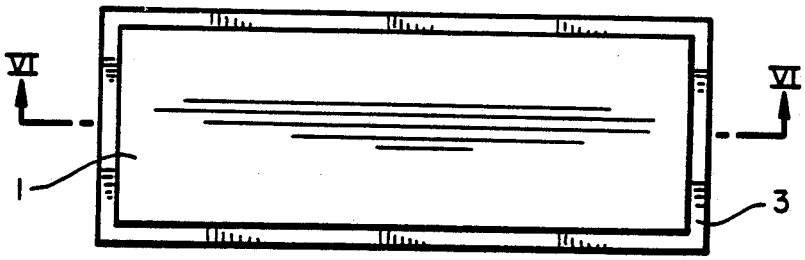
Figure 6:
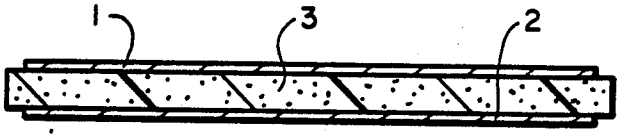

Preferred features of the invention are disclosed below. Such features can be used alone, or where appropriate, together in any combination.

Thus prefered features of the present invention include:

(a) the first electrode covers substantially all of the first face except for at least a part of said marginal portion, particularly substantially all of the first face except for a first continuous margin around the whole of the perimeter of the first face;

(b) the second electrode covers substantially all of the second face except for at least a part of said marginal portion, particularly substantially all of the second face except for a second continuous margin around the whole of the perimeter of the second face;

(c) the second heater has two straight sides which are parallel to each other, and the first electrode covers the whole of the first face except for (a) two margins which run down the whole length of each of the straight sides, and optionally (b) further margins which run down the whole length of each of the other sides, preferably a heater whose periphery consists of four straight sides, two of which are parallel to each other, e.g. a first pair of sides parallel to each other and a second pair of sides parallel to each other, preferably such a heater in which the first electrode covers the whole of the first face except for two margins which run down the whole length of each of the sides of the first part, and the second electrode covers the whole of the second face except for two margins which run down the whole length of each of the sides of the second pair;

(d) each of the electrodes is a continuous metal foil electrode, especially an electrodeposited metal foil electrode;

(e) at least a part of the marginal portion has been formed by removal of an electrode previously applied to the resistive element;

(f) the resistive element is at most 100 mils thick, preferably at most 50 mils thick; and (g) the distance between the first and second electrodes around the outside of the resistive element is at least 1.5 times, preferably at least 2 times, particularly at least 3.5 times, the thickness of the resistive element.

The laminar resistive element referred to herein comprises a conductive polymer composition. Particularly preferred compositions comprise a continuous matrix comprising a first organic polymer and a first particulate conductive filler which is distributed in the matrix and maintains its identity therein. Each particle of the first particulate conductive filler comprises a second organic polymer and a second particulate conductive filler which is distributed in the second polymer.

Figure 7:
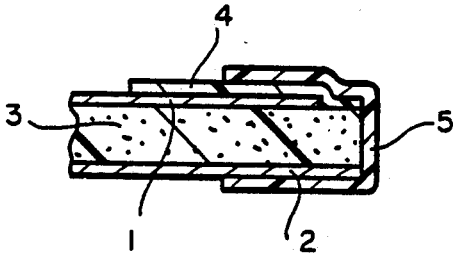
FIG. 7 is a cross-sectional view of a preferred method of insulating the edge of the heater.

Referring now the drawings, in each of the figures, reference numerals 1 and 2 denote metal foil electrodes and 3 denotes a resistive element composed of a conductive polymer. In FIG. 7, numerals 4 and 5 denote insulating tape which is secured to the substrate by an adhesive, and is preferably fused to ensure adequate insulation of the edges. Preferably after application of such tape, and after securing electrical leads to the electrodes, the whole heater is preferably further insulated, e.g. by dipping it into a curable epoxy resin.

EXAMPLE

A PTC conductive polymer powder was prepared by mixing 56% by wieght of Marlex 50100 (high density polyethylene made by Phillips Petroleum), 43% by weight of Statex GH (carbon black made by Columbian Chemicals), and 1% by weight of an antioxidant in a Banbury mixer. The resulting compound was irradiated to a does of 50 Mrads in a 3 MeV electron beam and pulverized until all the particles were smaller than 187 micrometers (80 mesh). This PTC powder was tumble-blended with an equal weight of Microthene FA750 (high density polyethylene made by USI Chemicals), and the blend was extruded in to a 12 inch by 0.030 inch (30.5×0.08 cm) sheet. Using a belt laminator, the sheet was laminated on each side with 0.0014 inch (0.0035 cm) metal foil (nickel/zinc passivated electrodeposited copper foil made by Yates Industries). The laminated sheet was cut into pieces of appropriate size and, using a router, the foil on the top surface was cut through a distance of 0.1875 inch (0.476 cm) from the edge around the perimeter of the piece. After removing the narrow strip of foil, a piece of 0.75 inch (1.91 cm) wide adhesive-backed mylar tape (Electrical Tape No. 56 from 3M) was applied to cover the exposed conductive polymer sheet and the edge of the foil. A second piece of tape was applied from the bottom surface foil over the first tape layer to cover the exposed edge of the conductive polymer sheet. The heater was conditioned at 125 degrees C. for one hour to condition the adhesive tape. Electrical leads were attached to the surface of the foil and the entire heater was then spray-coated with epoxy powder (Black Beauty ELB-400-P9, available from The Brien Corporation).

I claim:

1. An electrical heater which comprises (1) a laminar resistive element which (i) is composed of a conductive polymer which comprises a continuous matrix comprising a first organic polymer and a first particulate conductive filler which is distributed in the matrix and maintains its identity therein and each particle of which comprises a second organic polymer and a second particulate conductive filler which is distributed in the second polymer and (ii) has a first face and an opposite second face;

(2) a first laminar electrode, the whole of which is secured to the first face of the resistive element; and (3) a second laminar electrode, the whole of which is secured to the second face of the resistive element;

the first and second electrodes being connectable to a power supply, whereby current can be passed through the resistive element; and the first and second electrodes being so shaped and positioned that (a) when current passes between the electrodes, it does so in a direction which is substantially at right angles to the faces of the resistive element, and (b) there is a continuous marginal portion around the whole of the periphery of the resistive element in which at most one of the first and second electrodes is present.

2. A heater according to claim wherein the first electrode covers substantially all of the first face except for at least a part of said marginal portion.

3. A heater according to claim 2 wherein the first electrode covers substantially all of the first face except for a first continuous margin around the whole of the perimeter of the first face.

4. A heater according to claim 2 wherein the second electrode covers substantially all of the second face.

5. A heater according to claim 3 wherein the second electrode covers substantially all of the second face except for a second continuous margin around the whole of the peimeter of the second face.

6. A heater according to claim 1 which has two straight sides which are parallel to each other; and the first electrode covers the whole of the first face except for (a) two margins which run down the whole length of each of the straight sides, and optionally (b) further margins which run down the whole length of each of the other sides.

7. A heater according to claim 6 whose periphery consists of four straight sides, two of which are parallel to each other.

8. A heater according to claim 7 wherein the four straight sides comprise a first pair of sides parallel to each other and a second pair of sides parallel to each other.

9. A heater according to claim 8 wherein the first electrode covers the whole of the first face except for two margins which run down the whole length of each of the sides of the first part, and the second electrode covers the whole of the second face except for two margins which run down the whole length of each of the sides of the second pair.

10. A heater according to claim 1 wherein each of the electrodes is a continuous metal foil electrode.

11. A heater according to claim 10 wherein each of the electrodes is an electrodeposited foil electrode.

12. A heater according to claim 1 wherein at least part of the marginal portion has been formed by removal of an electrode previously applied to the resistive element.

13. A heater according to claim 1 wherein the resistive element is at most 100 mils thick.

14. A heater according to claim 13 wherein the resistive element is at most 50 mils thick.

15. A heater according to claim 1 wherein the distance between the first and second electrodes around the outside of the resistive element is at least 1.5 times the thickness of the resistive element.

16. A heater according to claim 15 wherein said distance is at least 2 times the thickness of the resistive element.

17. A heater according to claim 15 wherein said distance is at least 3.5 times the thickness of the resistive element.

* * * * *